US006851124B2

(12) United States Patent
Munoz et al.

(10) Patent No.: US 6,851,124 B2
(45) Date of Patent: Feb. 8, 2005

(54) KNEE PAD AND METHOD OF MANUFACTURE

(76) Inventors: Jose Munoz, 5901 Sheila St., City of Commerce, CA (US) 90040; Gustavo Gonzalez, 5901 Sheila St., City of Commerce, CA (US) 90040

( * ) Notice: Subject to any disclaimer, the term of this patent is extended or adjusted under 35 U.S.C. 154(b) by 495 days.

(21) Appl. No.: 10/027,456

(22) Filed: Dec. 21, 2001

(65) Prior Publication Data

US 2003/0115655 A1 Jun. 26, 2003

(51) Int. Cl.[7] ..... A41D 13/00
(52) U.S. Cl. ..... 2/24
(58) Field of Search ..... 2/24, 16, 22, 455, 2/242, 267, 911, 62; 128/878, 881, 882; 602/20, 23, 25–27, 62–63

(56) References Cited

U.S. PATENT DOCUMENTS

| | | | | | |
|---|---|---|---|---|---|
| 1,055,040 | A | * | 3/1913 | Herron et al. | 2/24 |
| 1,074,531 | A | * | 9/1913 | Schmitt | 2/24 |
| 1,090,408 | A | | 3/1914 | Peoples | |
| 1,404,723 | A | * | 1/1922 | Swope | 2/24 |
| 1,449,656 | A | * | 3/1923 | Compton | 2/24 |
| 1,480,374 | A | * | 1/1924 | Davis | 2/24 |
| 1,486,308 | A | | 3/1924 | Shook | |
| 1,571,088 | A | * | 1/1926 | Buchanan | 2/24 |
| 1,666,846 | A | | 4/1928 | Cooper | |
| 4,024,584 | A | | 5/1977 | Smith | |
| 4,772,071 | A | | 9/1988 | Richards | |
| 5,031,240 | A | | 7/1991 | Nierhaus | |
| 5,125,479 | A | | 6/1992 | Nemes et al. | |
| 5,309,570 | A | | 5/1994 | Grimm | |
| 5,652,956 | A | | 8/1997 | Hoshizaki et al. | |
| 5,794,261 | A | * | 8/1998 | Hefling | 2/16 |
| 5,865,782 | A | | 2/1999 | Fareed | |
| D406,406 | S | | 3/1999 | Hettwer | |
| 5,987,643 | A | * | 11/1999 | Beutler | 2/24 |
| D436,696 | S | | 1/2001 | Bonaventure et al. | |
| 6,173,448 | B1 | | 1/2001 | Kroposky | |

* cited by examiner

*Primary Examiner*—Tejash Patel

(57) ABSTRACT

A knee pad adapted to cover the knee of a user is made from a single sheet of durable, pliable sheet material, or from a plurality of separate segments made of such sheet material. It comprises a body having an open side, an elbow section and a leg section, said elbow section and a leg section joined to form a corner. A strap member is attached to extends between opposed sides of the leg section that enables the user to secure the knee pad to the user's knee with the knee placed into the open side and seated against the corner. Outer edges of the leg and elbow section are each inwardly contoured forming a concave indentation respectively in each of these outer edges.

29 Claims, 4 Drawing Sheets

10
18
22
22a
22b
24
24a
24b
24e
26
26a
26b
30
32
38
40
42
90
X1
X2
Z1
Z2
T
W
C1
C2
E1
E2
6
7
8

50
14
15
17
22c
38
30
Z1
X1
40
64
90a
38b
60
24
W
20
22
C1
C2
38d
24b
62
24c
X2
Z2
42
26
18

KNEE PAD AND METHOD OF MANUFACTURE

BACKGROUND OF INVENTION

Knee pads are commonly used in the construction industry by workers who are required to kneel when performing their tasks. Such knee pads are usually made form a single sheet of pliable material such as leather or rubber sold under the trademark Neolite. The knee pad has an open side and an elbow section joined to a leg section to form a corner. The user places the open side over his or her knee and lodges the knee into the corner. A strap extends across opposed sides or edges of the leg section that enables the user to secure the knee pad in position to press the interior of the knee pad against the knee. The inside of the knee pad is lined with a sheet of foam rubber or felt.

One problem with conventional knee pads is that they don't fit comfortably on the user's knee when the user stands and walks around. As depicted in FIGS. 1 and 2, the outer edges of the front walls of the elbow and leg sections of a conventional knee pad are straight and at a right angle to sides of these sections or bowed outward. It would be advantageous to make these conventional knee pads more comfortable, especially when the user is standing or walking. Another problem is that the conventional knee pads tend to move sideways as the user walks. This is due to the generally rounded cross-sectional shape of the leg section that results from the knee pad being made from a single sheet of the pliable material.

SUMMARY OF INVENTION

This invention has several features, no single one of which is solely responsible for its desirable attributes. Without limiting the scope of this invention as expressed by the claims that follow, its more prominent features will now be discussed briefly. After considering this discussion, and particularly after reading the section entitled, "DETAILED DESCRIPTION," one will understand how the features of this invention provide its benefits, which include, but are not limited to, a more comfortable knee pad and a knee pad that does not easily move sideways when being worn.

The first feature of the knee pad of this invention is that it includes a body having an open side, an elbow section and a leg section, with the elbow section and the leg section joined to form a corner. The elbow section and leg section each have opposed side walls connected by a front wall, and the elbow section and leg section are of different lengths. The length of the elbow section is substantially shorter than the length of the leg section. A strap member attached to the leg section extends between the opposed side walls of the leg section.

The second feature is that the opposed side walls of the elbow section each have an outer side edge and the front wall of the elbow section has an outer edge that extends between the outer side edges of the opposed side walls of the elbow section. The opposed side walls of the leg section each have an outer side edge and the front wall of the leg section has an outer edge that extends between the outer side edges of the opposed side walls of the leg section. The front walls of the elbow section and the leg section are of substantially the same width and each have a central longitudinal axis. These longitudinal axes intersect to form an angle from about 90 to about 100 degrees.

In accordance with the third, and most important feature of this invention, the outer edges of the front walls of the elbow section and the leg section are each inwardly contoured forming a concave indentation in the front walls of the elbow section and the leg section. The concave indentation in the elbow section's front wall has a zenith at the central longitudinal axis of said elbow section front wall, and the concave indentation in the leg section's front wall has a zenith at the central longitudinal axis of the leg section's front wall. The opposed side walls of the leg section each have substantially the same width and, preferably, the distance between the corner and the zenith of the concave indentation in the elbow section's front wall is substantially equal to the width of opposed side walls of the leg section. Each concave indentation has a depth of from 1 to 2 inches, and preferably the depth of each concave indentation is substantially the same. The concave indentations preferably have substantially the same shape such as sections of a circle. Preferably, the concave indentations are mirror images.

In accordance with the fourth, and important feature of a second embodiment of this invention, the body of the knee pad is formed from a plurality of separate segments made of durable, pliable sheet material. At least some of these segments have edges that overlap, with the overlapping edges joined by at least one connector. These segments include a pair side segments, a front segment, and an elbow segment. The side segments are substantially at a right angle to the front segment when the strap member secures the knee pad to the user's knee. The side segments preferably are substantially rectangular. The knee pad has a predetermined width and the elbow segment has a width that is substantially wider than the predetermined width of the knee pad to provide outer connector portions that are bent inward to overlap portions of the side segments. The outer connector portions have at least one connector attaching each of the outer connector portions to one side segment. The front walls of the elbow section and the leg section side walls when formed using separate segments each have central longitudinal axis that intersect at substantially at 90 degrees with respect to each other. Also, the side walls of the elbow section substantially at 90 degrees with respect to the front wall of the elbow section, and the side walls of the leg section substantially at 90 degrees with respect to the front wall of the leg section.

The fifth feature of this invention is that the knee pad has a to width of from about 4.25 to about 5.25, a length of from about 5.5 to about 8 inches, and the opposed side walls of the leg section have equal widths of from about 1.5 to about 2.5 inches. The elbow section has a length of from about 1.5 to about 4.5 inches with opposed rounded corners that project outwardly from the side walls of the leg section. These opposed rounded corners each have a height of from about 3 to about 4 inches measured from the front wall of the leg section.

The sixth feature is that the

This invention also includes a method of making a knee pad.

This method includes:

(a) providing a plurality of separate segments each made of a durable, pliable sheet material and each having side edges, (b) forming said segments into said knee pad by overlapping and connecting portions of the segments along their side edges, including bending said connected portions inward to provide said knee pad with a body having an open side, an elbow section and a leg section, said leg section having side walls formed from at least a pair of said segments connected to another segment forming a front wall of the leg section, said pair of segments being substantially at a right angle to the segment forming the front wall of the leg section.

In this method the outer edge of the front section and the outer edge of the elbow section may each be inwardly contoured to form concave indentations in these edges. Preferably, these concave indentations are formed by cutting the segments along outer edges corresponding to the outer edges of the front and sections prior to connecting the segments together.

DESCRIPTION OF DRAWINGS

The preferred embodiments of this invention, illustrating all its features, will now be discussed in detail. These embodiments depict the novel and non-obvious knee pad of this invention and its method of manufacture as shown in the accompanying drawings, which are for illustrative purposes only. These drawings includes the following figures (FIGS.), with like numerals indicating like parts.

DETAILED DESCRIPTION

First Embodiment

Figures 5, 6, 7, 8, 9, 10:
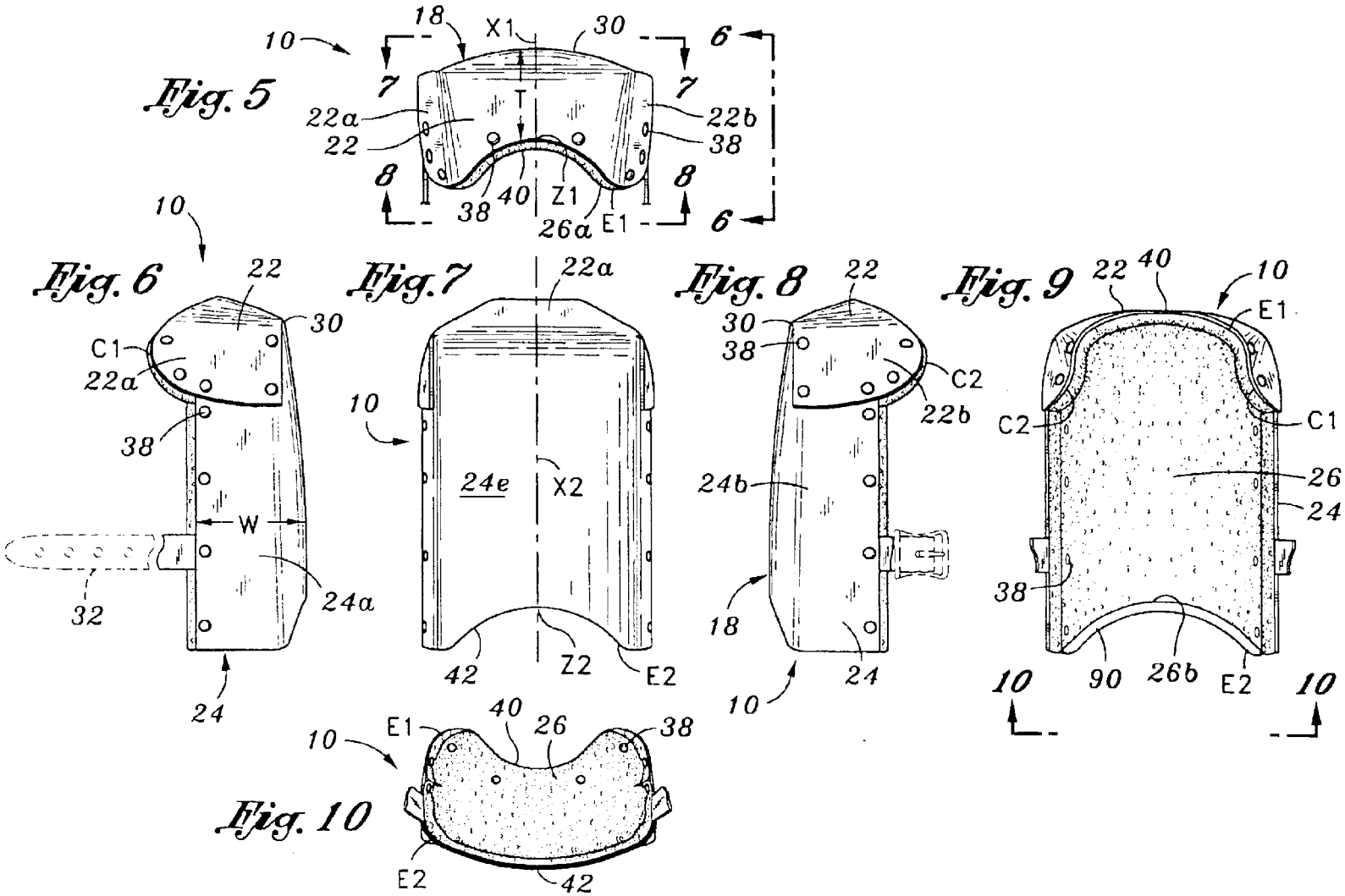
FIG. 5 is a top plan view of the knee pad of this invention shown in FIG. 3.
FIG. 6 is a side elevational view of the knee pad of this invention taken along line 6—6 of FIG. 5.
FIG. 7 is a front elevational view of the knee pad of this invention taken along line 7—7 of FIG. 5.
FIG. 8 is a side elevational view of the knee pad of this invention taken along line 8—8 of FIG. 5.
FIG. 9 is an elevational view of the backside of the knee pad of this invention taken along line 9—9 of FIG. 5.
FIG. 10 is a bottom plan view of the knee pad of this invention taken along line 10—10 of FIG. 9.
Figure 11:
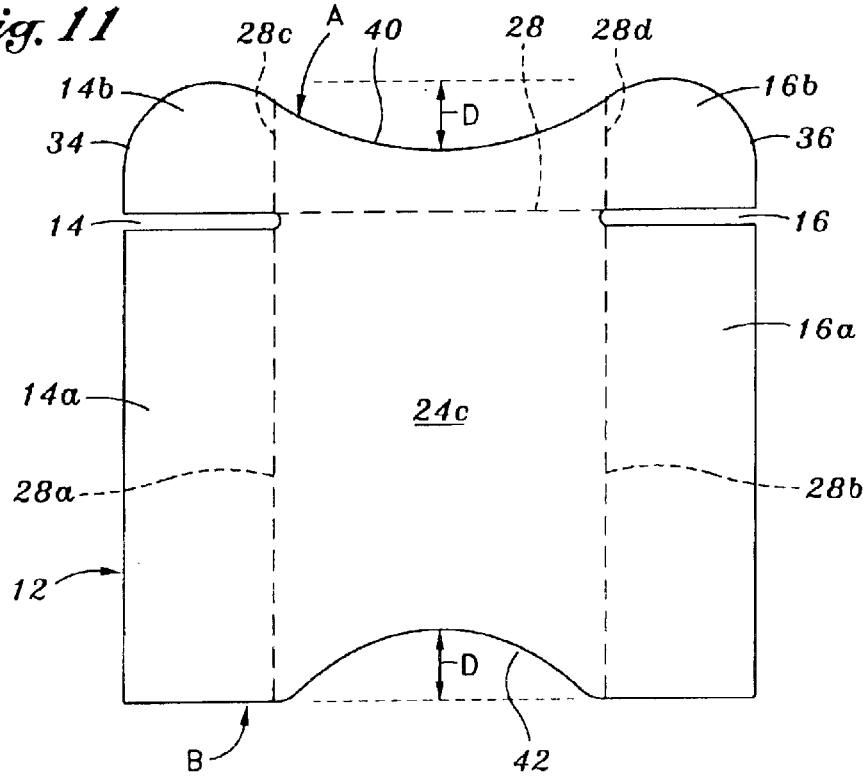
FIG. 11 is a plan view of the single sheet of material from which to the knee pad of this invention shown in FIGS. 3 through 10 is made.
Figure 12:
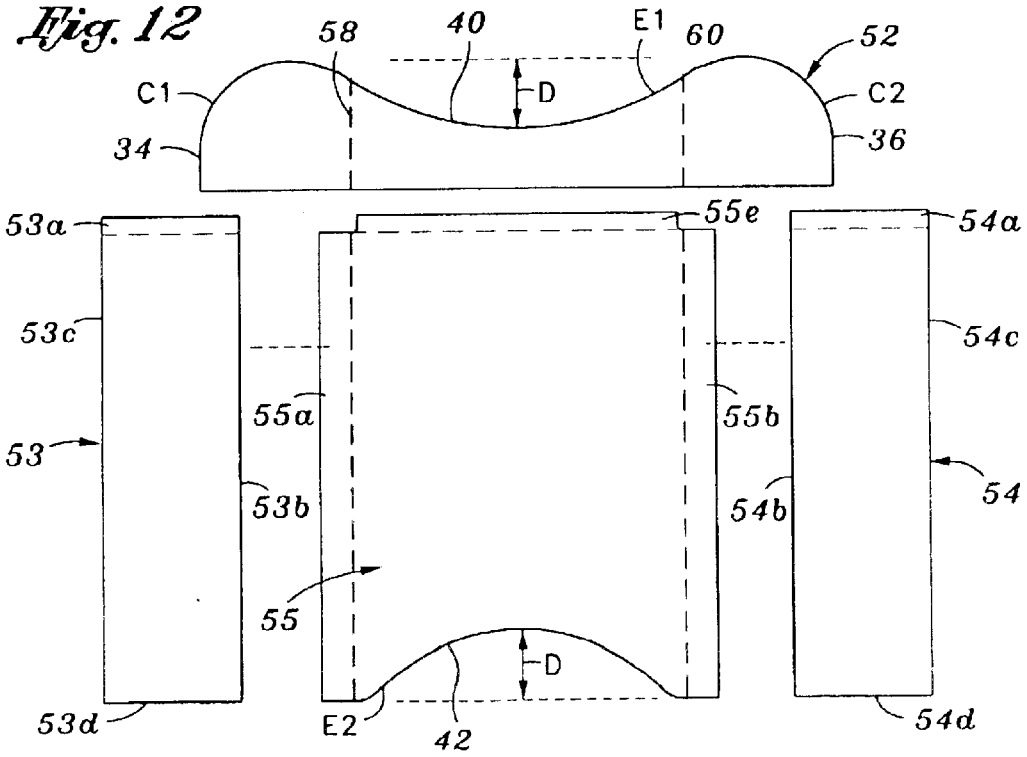
FIG. 12 is a plan view of the three sheets of material from which the second embodiment of the knee pad of this invention shown in FIGS. 13 through 18 is made.
Figures 13, 14, 15, 16, 17, 18:
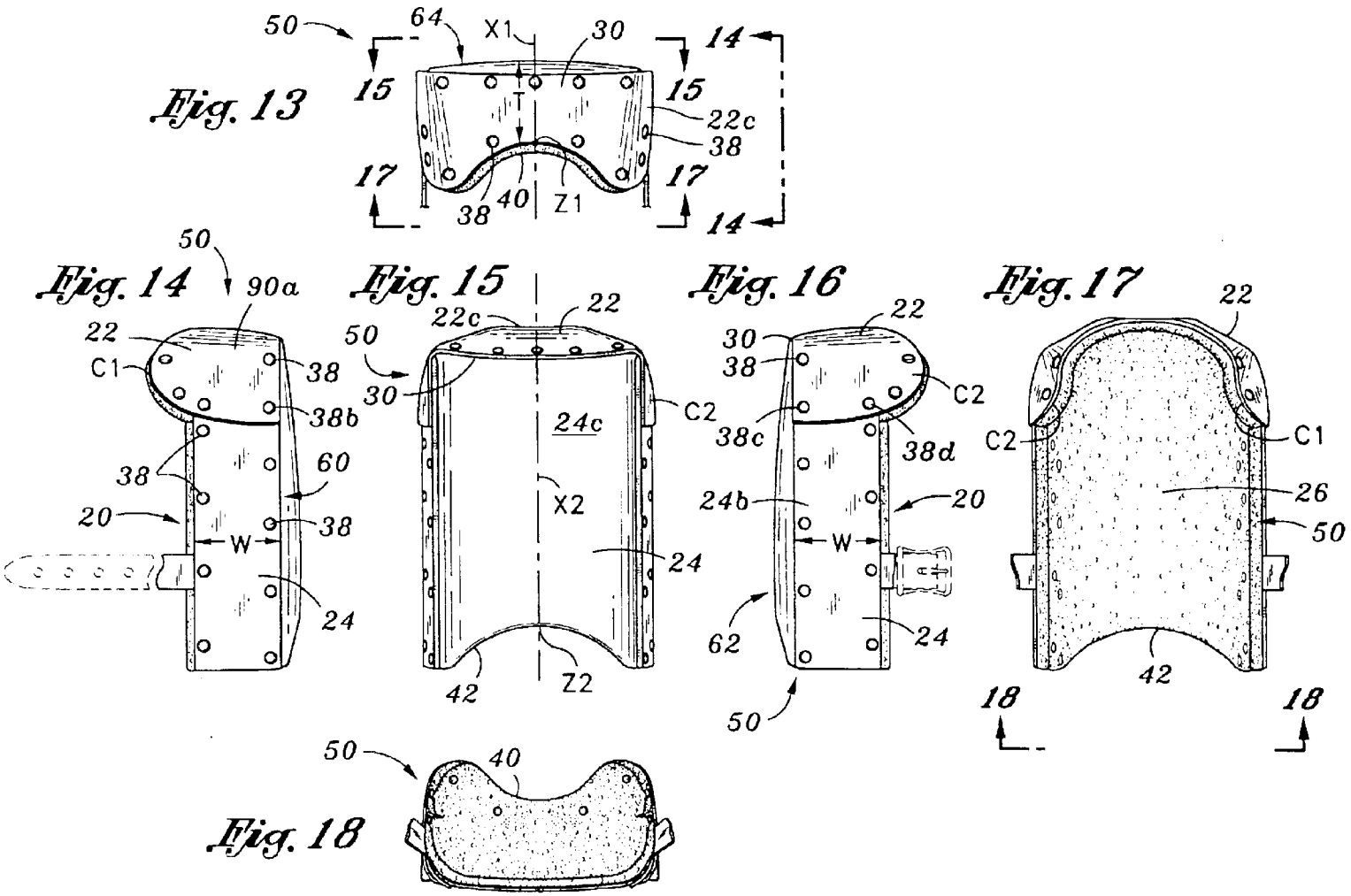
FIG. 13 is a top plan view of the second embodiment of the knee pad of this invention.
FIG. 14 is a side elevational view of the knee pad of this invention taken along line 14—14 of FIG. 13.
FIG. 15 is a front elevational view of the knee pad of this invention taken along line 15—15 of FIG. 13.
FIG. 16 is a side elevational view of the knee pad of this invention taken along line 16—16 of FIG. 13.
FIG. 17 is an elevational view of the backside of the knee pad of this invention taken along line 17—17 of FIG. 13.
FIG. 18 is a bottom plan view of the knee pad of this invention taken along line 18—18 of FIG. 17.

The first embodiment of this invention, the knee pad 10 shown in FIGS. 3 through 10, is made from a single sheet 12 (FIG. 11) of durable, pliable sheet material such as leather or rubber. The sheet material 12 has a thickness of about ⅛ inch, and it is slit along the lines 14 and 16 to form an upper portion A and a lower portion B, defining marginal portions 14*a*, 14*b*, 16*a*, 16*b* may be bent inward to form, as depicted in FIGS. 3 through 10, a body 18 having an open side 20, an elbow section 22 and a leg section 24. The elbow section 22 has a length of about 3 inches, and the leg section 24 has a length of about 7 inches in this embodiment. Consequently, the length of the elbow i=2 section 22 is substantially shorter than the length of the leg section 24. As best shown in FIGS. 9 and 10, the interior of the knee pad 10 is covered with liner material 26 of foam or felt having a uniform thickness, made of one or more plies, ranging from about ⅛ to about 1 inch.

The elbow section 22 and a leg section 24 are integral and are formed by folding the upper portion A and lower portion B along the line 28 (FIG. 11) of the sheet 12 to form a corner 30. The elbow section 22 is formed by folding the opposed marginal portions 14*b* and 16*b* of the upper portion A inward along the lines 28*c* and 28*d*. The leg section 24 is formed by folding the opposed marginal portions 14*a* and 16*a* of the lower portion B inward along the lines 28*a* and 28*b*. This creates side walls and front walls, with the elbow section 22 having opposed side walls 22*a* and 22*b* and leg section 24 having opposed side walls 24*a* and 24*b*. The opposed side walls 22*a* and 22*b* are connected by a front wall 22*c* and the opposed side walls 24*a* and 24*b* are connected by a front wall 24. The front wall 22*c* of the elbow section 22 and the front wall 24*c* of the leg section 24 are of substantially the same width, which is from about 4.50 in this embodiment. Each have a central longitudinal axis X1 and X2, respectively, and these longitudinal axes intersect to form an angle from about 90 to 100 degrees.

Figure 1:
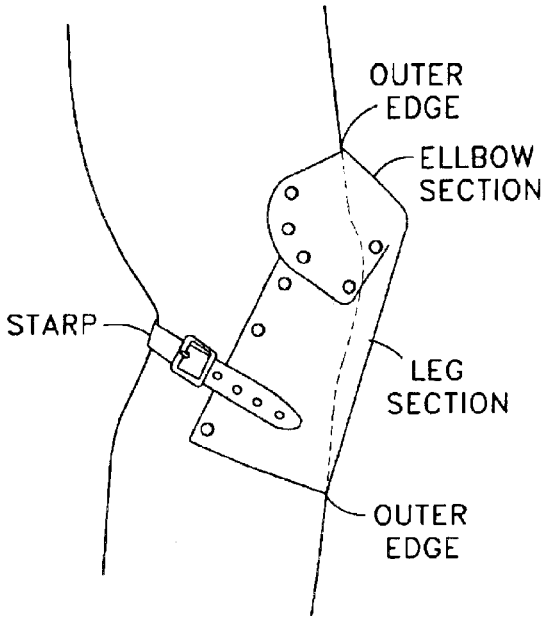
Fig. 1 (PRIOR ART)
FIG. 1 is a side elevational view of a prior art knee pad being worn by a user.
Figure 2:
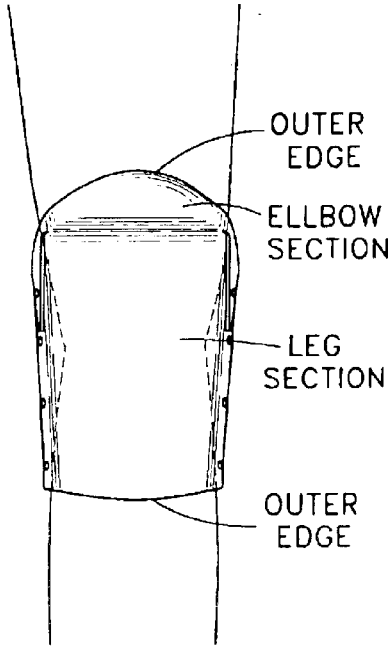
Fig. 2 (PRIOR ART)
FIG. 2 is a front elevational view of the prior art knee pad shown in FIG. 1 being worn by a user.
Figure 3:
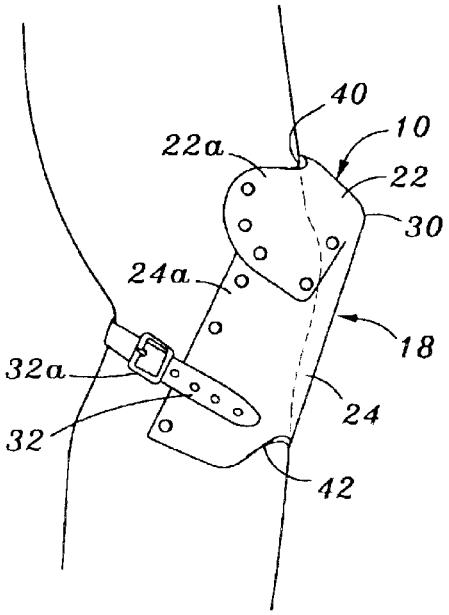
FIG. 3 is a side elevational view of the first embodiment of the knee pad of this invention being worn by a user.
Figure 4:
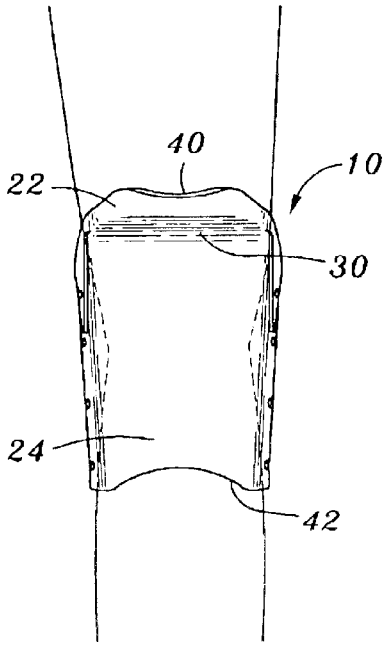
FIG. 4 is a front elevational view of the knee pad of this invention shown in FIG. 3 being worn by a user.

Because the single sheet 12 is used to make the knee pad 10, the side walls 24*a* and 24*b* are integral with the front wall 24*c* of the leg section 24. These side walls 24*a* and 24*b* are of equal heights of about 7 inches. A strap 32 extends between the side walls 24*a* and 24*b* that includes a buckle 32*a*. The user secures the knee pad 10 to his or her leg by first unbuckling the buckle 32*a*, then placing the knee pad over his or her knee with knee lodged in the corner 30 as depicted in FIG. 3. The user then buckles the strap 32 to hold the knee pad 10 with the liner material 26 pressed snug against the user's knee. Other types of straps may be employed using for example a hook and fabric connector such as Velcro or the buckle could be eliminated and the strap made of a continuous strip of elastic.

The opposed marginal portions 14*b* and 16*b* of the front wall 22*c* of the elbow section 22 form the side walls 22*a* and 22*b*, respectively. Because the single sheet 12 is used to make the knee pad 10, the side walls 22*a* and 22*b* are integral with the elbow section's front wall 22*c*. The distance between the opposed outer extremities 34 and 36 of the upper portion A is substantially greater than the width of the knee pad 10, which is from about 4.50. These outer extremities 34 and 36 of the upper portion A provide outer connector portions of the elbow section 22 that are folded inward along the lines 28c and 28d to overlap with each side wall 24*a* and 24*b* of the leg section 24.

There are rivets 38 projecting through the overlapping portions to connect each side wall 22*a* and 22*b* of the elbow section 22 to one side wall 24*a* and 24*b* of the leg section 24. Rivets 38 also secure the liner material 26 to the interior of the knee pad. The outer extremities 34 and 36 of the side walls 22*a* and 22*b* of the elbow section 22 each include rounded, outer corners C1 and C2. These corners C1 and C2 are respectively folded over each of the side walls 24*a* and 24*b* of the leg section 24 and project outwardly from each of these side walls 24*a* and 24*ba* distance of about 1 inch.

These opposed rounded corners C1 and C2 each have a maximum height of from about 2.5 to about 4 inches, typically 3 inches measured from the front wall 24*c* of the leg section 24.

In accordance with this invention, the front wall 22*c* of the elbow section 22 and the front wall 24*c* of the leg section 24 each have an outer edge E1 and E2 respectively. The outer edge E1 extends between the rounded corners C1 and C2 of the elbow section 22, and the outer edge E2 extends between the side walls 24*a* and 24*b* of the leg section 24. Each of these outer edges E1 and E2 is inwardly contoured forming therein concave indentations 40 and 42, respectively. Each concave indentation 40 and 42 has a depth D of from 1 to 2 inches. Preferably the depth D of each concave indentation 40 and 42 is substantially the same, and the concave indentations 40 and 42 have substantially the same shape, being sections of a circle that are mirror images of each other.

The concave indentation 40 in the elbow section's front wall 22*c* has a zenith Z1 at the central longitudinal axis X1 of this front wall 22*c*, and the concave indentation 42 in the leg section's front wall 24*c* has a zenith Z2 at the central longitudinal axis X2 of this front wall 24. The opposed side walls 24*a* and 24*b* of the leg section 24 each have substantially the same width W. The distance T between the corner 30 and the zenith Z1 of the concave indentation 40 in the elbow section's front wall 22*c* is substantially equal to the width W of opposed side walls 24*a* and 24*b* of the leg section 24. In this embodiment, the width of the opposed side walls 24*a* and 24*b* of the leg section 24 is about 2 inches.

In accordance with another feature of this invention, the liner material 26 has one edge portion 26*a* extending outward from the edge E1 of the front wall 22*c* of the elbow section 22 as best shown in FIG. 5, another one edge portion 26*b* is set back from the edge E2 of the front wall 24*c* of the leg section 24 as best shown in FIG. 9. Each of these edge portions 26*a* and 26*b* have substantially the same shapes as the concave indentations 40 and 42, respectively, to which they are adjacent. The edge portion 26*a* extends outward from the edge E1 a distance of from about ⅛ to about ½ inch. The set back of the edge portion 26*b* from the edge E2 exposes an inside surface 90 of the front wall 24*c*. The edge portion 26*b* is from about ⅛ to about ½ inch from the edge E2. The positioning of the liner material 26 in this manner improves the comfort of the knee pad 10 when being worn by a user.

Because the knee pad 10 is made from a single sheet of pliable material 12, its cross-sectional shape is curved prior to attaching to the user's knee. In some cases this may be acceptable, but the second embodiment discussed subsequently, avoids the problem of a knee pad with such a curved cross-sectional shape moving when the user is walking with the knee pad 10 secure to the user's knee.

Second Embodiment

The second embodiment of this invention, the knee pad 50 shown in FIGS. 13 through 18, is similar to the first embodiment, the knee pad 10, and the same numerals are used for common components. Like the first embodiment, the knee pad 50 has an elbow section 22 and a leg section 24 joined at a corner 30, and a strap 32 attached to the leg section to enable the user to secure the knee pad 50 to the user's knee. The front walls 22*c* and 24*c* of the elbow and leg sections respectively have outer edges E1 and E2 that are inwardly contoured forming thereat concave indentations 40 and 42, respectively. Each concave indentation 40 and 42 has a depth D of from 1 to 2 inches, preferably each indentation is of the same depth. The concave indentations 40 and 42 have the same shape, being sections of a circle that are mirror images of each other. The concave indentation 40 in the elbow section's front wall 22*c* has a zenith at the central longitudinal axis X1 of this front wall 22*c*, and the concave indentation 42 in the leg section's front wall 24*c* has a zenith at the central longitudinal axis X2 of this front wall 24.

The main difference between the first and second embodiments is that the knee pad 50 is made from four separate segments 52, 53, 54, and 55, each made of a durable, pliable sheet material such as leather. The segment 52 is the elbow segment and it forms the elbow section 22. The segments 53 and 54 are the side segments and the segment 55 is the front segment. These segments 53, 54 and 55 form the leg section 24. One of the advantages of using these separate segments 52, 53, 54, and 55 is that the side walls 22*a* and 22*b* of the elbow section 22 and the side walls 24*a* and 24*b* of the leg section 24 are orient substantially at a right angle to the front walls 22*c* and 24*c*, respectively. This minimizes sideways any movement of the knee pad 50 while being worn by a user.

The elbow segment 52 has opposed side edges, or outer extremities 34 and 36, an inner edge E3, and an outer edge E1. The side edges or the outer extremities 34 and 36 are spaced apart so that the elbow segment is longer than the width (about 4 inches) of the knee pad 50. It includes the concave indentation 40 between the outer extremities 34 and 36 along the outer edge E1 of this elbow segment 52. The elbow segment 52 has rounded, outer corners C1 and C2 at the extremities 34 and 36, respectively. The side segment 53 has at a forward end a marginal edge 53*a*, and the side segment 54 has at a forward end a marginal edge 54*a*. Each side segment 53 and 54 an inner edge 53*b* and 54*b*, respectively, and outer edge 53*c* and 54*c*, respectively, and a rear end 53*d* and 54*d*, respectively. The front segment 55 has opposed marginal edges 55*a* and 55*b*, inner marginal edge 55*c*, and outer edge E2. The concave indentations 40 and 42 are formed by cutting respectively the segment 52 and 55 along their respective outer edges E1 and E2, preferably prior to connecting the segments together.

The segments 52, 53, 54, and 55 are assembled and attached by rivets 38 to form the knee pad 50 shown in FIGS. 13 through 18. The marginal edge 55*a* of the segment 55 is placed beneath an inside edge 53*b* of the segment 53 and aligned so that these edges are coextensive. Rivets 38 are then inserted as a row 60 (FIG. 14) into these overlapping edges 53*b* and 55*a*. The marginal edge 55*b* of the segment 55 is placed beneath an inside edge 54*b* of the segment 54 and aligned so that these edges are coextensive. Rivets 38 are also then inserted as a row 62 (FIG. 16) into these overlapping edges 55*b* and 54*b*. The marginal edge 55*c* is centered with, and beneath, an edge E3 of the segment 52 and a row 64 (FIG. 13) of rivets 38 secure the segment 55 to the segment 52. The segments 53 and 54 are then folded inward in the same direction substantially at a right angle to form the side walls 24*a* and 24*b* and the front wall 24*c* of the leg section 24. The corners C1 and C2 of segment 52 are folded about the lines 58 and 60 to cover, respectively, the marginal edges 53*a* and 54*a*. Rivets 38*a* and 38*b* secure the overlapping corner C1 to the marginal edge 53*a*, and rivets 38*c* and 38*d* secure the overlapping corner C2 to the marginal edge 53*a*. This forms the side walls 22*a* and 22*b* and the front wall 22*c* of the elbow section 22. The liner material 26 is placed in position prior to riveting the segments 52, 53, 54 and 55 together. The rivets 38 along the outer edges of the knee pad 50, as well as the rivets holding the segments 52, 53, 54 and 55 together, retainer the liner material 26 in place.

With the segments 52, 53, 54 and 55 riveted together the body 18 of the knee pad 50 is formed having an open side 20, and the elbow section 22 and the leg section 24 joined at the corner 30. The elbow section's front wall 22*c* is at substantially 90° with respect to the front wall 24*c* of the leg section 24. Moreover, the side walls 22*a* and 22*b* of the elbow section 22 are at substantially 90° with respect to the front wall 22*c* of the elbow section, and the side walls 24*a* and 24*b* of the leg If section 24 are also at substantially 90° with respect to the front wall 24*c* of the leg section. Consequently, the opposed side walls 24*a* and 24*b* do not gently curve outward as they do in of the knee pad 10, the first embodiment.

With the strap 32 attached to extend between the side segments 53 and 54 and wrapped around the user's leg to secure the knee pad 50 in place covering the user's knee, the side segments 53 and 54 and the central portion elbow segment 52 are substantially at a right angle to the front segment 55. This creates a substantial right angle relationship between the front wall 22*c* and 24*c* of the elbow and leg segments and the substantial right angle relationship side walls 24*a* and 24*b* and the front wall 24*c* of the leg section 24 that prevents excessive sideways movement of the pad 50 during walking or kneeling. Nevertheless, the indentations 40 and 42, in addition to providing the desired comfort when walking with the knee pad 50 secured to the user's knee, assist in minimizing sideways movement of the pad during walking or kneeling. It is counter-intuitive to make the knee pad 50 from a plurality of separate segments 52, 53, 54 and 55 rather than from a single sheet, because of the added costs. But using the manufacturing method of this invention where the separate segments 52, 53, 54 and 55 are connected together avoids the problem of movement of the pad during walking or kneeling.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiments disclosed. On the contrary, the intention is to cover all modifications and alternate constructions coming within the spirit and scope of the invention as generally expressed by the following claims, which particularly point out and distinctly claim the subject matter of the invention:

What is claimed is:

1. In a knee pad with a body having an open side, an elbow section and a leg section, said elbow section and leg section joined to form a corner, said elbow section and leg section each having opposed side walls connected by a front wall, said elbow section and leg section being of different lengths, with the length of the elbow section being substantially shorter than the length of the leg section, said opposed side walls of the elbow section each having an outer side edge and said front wall of the elbow section having an outer edge that extends between the outer side edges of the opposed side walls of the elbow section, said opposed side walls of the leg section each having an outer side edge and said front wall of the leg section having an outer edge that extends between the outer side edges of the opposed side walls of the leg section, and a strap member attached to the leg section to extended between the opposed side walls of said leg section, the improvement comprising the outer edges of the front walls of the elbow section and the leg section are each inwardly contoured forming a concave indentation in said front walls of the elbow section and the leg section.

2. The improved knee pad of claim 1 where the front walls of the elbow section and the leg section are of substantially the same width and each have a central longitudinal axis, said longitudinal axes intersecting to form an angle from 90 to 100 degrees, and the concave indentation in the elbow section front wall has a zenith at the central longitudinal axis of said elbow section front wall, and the concave indentation in the leg section front wall has a zenith at the central longitudinal axis of said leg section front wall.

3. The improved knee pad of claim 2 where the opposed side walls of the leg section each have substantially the same width and the distance between the corner and the zenith of the concave indentation in the elbow section front wall is substantially equal to said width of opposed side walls of the leg section.

4. The improved knee pad of claim 1 where each concave indentation has a depth of from 1 to 2 inches.

5. The improved knee pad of claim 4 where the depth of each concave indentation is substantially the same.

6. The improved knee pad of claim 1 where concave indentations have substantially the same shape.

7. The improved knee pad of claim 1 where concave indentations are sections of a circle.

8. The improved knee pad of claim 1 where the concave indentations are mirror images.

9. The improved knee pad of claim 1 where the body is formed from a plurality of separate segments made of durable, pliable sheet material, at least some of said segments having edges that overlap, with the overlapping edges joined by at least one connector.

10. A knee pad adapted to cover the knee of a user comprising a body having an open side, an elbow section and a leg section, said elbow section and a leg section joined to form a corner, and a strap member attached to the leg section that enables the user to secure the knee pad to the user's knee with the knee placed into the open side and seated against the corner, said body being formed from a plurality of separate segments including a front segment having opposed side edges and an inner edge, a pair of side segments, and an elbow segment, each side segment attached to one of the opposed side edges of the front segment, and the elbow segment attached to the inner edge of the front segment, said side segments being substantially at a right angle to the front segment when the strap member secures the knee pad to the user's knee, wherein the front segment Has an outer edge and the elbow segment has an outer edge, each outer edge being inwardly contoured forming a concave indentation respectively in said front segment and said elbow segment.

11. The knee pad of claim 10 where at least some of the segments overlap to form connection portions and there is at least one connector along and adjoining the overlapping connection portions.

12. The knee pad of claim 10 where the side segments are substantially rectangular.

13. The knee pad of claim 12 where the knee pad has a predetermined width and the elbow segment has a width that is substantially wider than the predetermined width of the knee pad to provide outer connector portions that are bent inward to overlap portions of the side segments, said outer connector portions having at least one connector attaching each of said outer connector portions to one side segment.

14. The knee pad of claim 13 where the elbow segment has opposed rounded corners that project outwardly from the side segments and an outer edge between said rounded corners that is inwardly contoured forming a concave indentation therein.

15. The knee pad of claim 14 where the front segment has an outer edge that is inwardly contoured forming a concave indentation therein.

16. The knee pad of claim 10 where the elbow section and a leg section are of substantially the same width and each have a central longitudinal axis and an outer edge that is inwardly contoured forming a concave indentation therein, said longitudinal axes intersecting to form an angle of substantially 90 degrees, and the concave indentation in the elbow section front wall has a zenith at the central longitudinal axis of said elbow section front wall, and the concave indentation in the leg section front wall has a zenith at the central longitudinal axis of said leg section front wall.

17. The knee pad of claim 16 where the side segments form opposed side walls of the leg section, each said side wall having substantially the same width and the distance between the corner and the zenith of the concave indentation in the elbow section front wall being substantially equal to said width of opposed side walls of the leg section.

18. The knee pad of claim 16 where each concave indentation has a depth of from 1 to 2 inches.

19. The knee pad of claim 18 where the depth of each concave indentation is substantially the same.

20. The knee pad of claim 18 where concave indentations have substantially the same shape.

21. The knee pad of claim 18 where concave indentations are sections of a circle.

22. The knee pad of claim 18 where the concave indentations are mirror images.

23. The knee pad of claim 10 where each segment is made of a durable, pliable sheet material.

24. A knee pad comprising a body having an open side, an elbow section and a leg section, said elbow section and a leg section joined to form a corner, said elbow section and leg section each having opposed side walls connected by a front wall, said elbow section and leg section being of different lengths, with the length of the elbow section being substantially shorter than the length of the leg section, said opposed side walls of the elbow section each having an outer side edge and said front wall of the elbow section having an outer edge that extends between the outer side edges of the opposed side walls of the elbow section, said opposed side walls of the leg section each having an outer side edge and said front wall of the leg section having an outer edge that extends between the outer side edges of the opposed side walls of the leg section, said body being formed from a plurality of separate segments made of durable, pliable sheet material, at least some of said segments having edges that overlap, with the overlapping edges joined by at least one connector, and a strap member attached to the leg section to extended between the opposed side walls of said leg section, the outer edges of the front walls of the elbow section and the leg section each being inwardly contoured forming a concave indentation in said front walls of the elbow section and the leg section.

25. The knee pad of claim 24 having a width of from 4.25 to 5.25, a length of from 5.5 to 8 inches, and the opposed side walls of the leg section have equal widths of from 1.5 to 2.5 inches, the elbow section has a length of from 1.5 to 2.5 inches and opposed rounded corners that project outwardly from the side walls of the leg section, and said opposed rounded corners each have a height of from 3 to 4 inches measured from the front wall of the leg section, and each concave indentation has a depth of from 1 to 2 inches.

26. The knee pad of claim 24 including a liner material at the open side having one edge portion extending outward from the outer edge the front wall of the elbow section and another edge portion set back from the outer edge of the front wall of the leg section.

27. A method of making a knee pad adapted to cover the knee of a user comprising (a) providing plurality of separate segments each made of a durable, pliable sheet material, said segments including a front segment having opposed side edges and an outer edge and inner edge, a pair of side segments each having an inner edge, outer edge, a forward end and a rear end, and an elbow segment having opposed side edges and an inner edge and an outer edge, said side edges of the elbow segment being spaced apart so that the elbow segment is longer than a predetermined width of the knee pad being made, (b) forming said segments into a body having an open side, an elbow section and a leg section by (i) overlapping a portion of the front segment along the inner edge of the front segment with a portion of the elbow segment along the inner edge of said elbow segment and connecting the overlapping portions together, (ii) overlapping the front segment along one side edge with a portion of the one side segment along the inner edge of said one side segment and connecting the overlapping portions together, (iii) overlapping the other side edge of the front segment with a portion of the other side segment along the inner edge of said other side segment and connecting the overlapping portions together, and (iv) overlapping a portion of the front segment along the inner edge of the front segment with a central portion of the of the elbow segment along the inner edge of said elbow segment and connecting the overlapping portions together so that opposed portions of the elbow segment at said side edges of the elbow segment may be bent inward, (iv) bending the connected segments inward and overlapping the opposed portions of the elbow segment respectively with the forward ends of each side segment and connecting together the overlapping portions the opposed portions of the elbow segment with each said forward ends, and (c) attaching a strap member to extend between the side segments, said side segments and said elbow segment being substantially at a right angle to the front segment when the strap member secures the knee pad to the user's knee wherein the outer edge of the front segment and the outer edge of the elbow segment are each inwardly contoured to form a concave indentation respectively in said front segment and said elbow segment.

28. The method of claim 27 where the concave indentations are formed by cutting the front and elbow segments along their respective outer edges prior to connecting the segments together.

29. A method of making a knee pad adapted to cover the knee of a user comprising (a) providing a plurality of separate segments each made of a durable, pliable sheet material and each having side edges, (b) forming said segments into said knee pad by overlapping and connecting portions of the segments along their side edges, including bending said connected portions inward to provide said knee pad with a body having an open side, an elbow section and a leg section, said leg section having side walls formed from at least a pair of said segments connected to another segment forming a front wall of the leg section, said pair of segments being substantially at a right angle to the segment forming the front wall of the leg section.

* * * * *